US006039328A

United States Patent [19]

Pawlowski et al.

[11] Patent Number: 6,039,328

[45] Date of Patent: Mar. 21, 2000

[54] ICE SKATE BLADE

[76] Inventors: Christoph Pawlowski, Nordenhamer Strasse 231, Delmenhorst, Germany, 27751; Günter Langer, Walter-Flex-Weg 24b, Delmenhorst, Germany, 27753; Wilhelm Meyer, Buchenstrasse 19, Brake, Germany, 26919

[21] Appl. No.: 08/889,483

[22] Filed: Jul. 8, 1997

[30] Foreign Application Priority Data

Aug. 13, 1996 [DE] Germany ..... 296 13 965 U
Jan. 14, 1997 [DE] Germany ..... 297 00 477 U

[51] Int. Cl.[7] ..... A63C 17/18

[52] U.S. Cl. ..... 280/7.13; 280/7.14; 280/11.12; 280/11.18

[58] Field of Search ..... 280/7.12, 7.13, 280/11.12, 11.19, 11.22, 11.27, 11.3, 7.14, 11.18, 11.17, 28, 841

[56] References Cited

U.S. PATENT DOCUMENTS

| | | | |
|---|---|---|---|
| 992,443 | 5/1911 | Oldfield | 280/7.13 |
| 1,100,976 | 6/1914 | Hille | 280/11.18 |
| 1,266,386 | 5/1918 | Barr | 280/11.12 |
| 1,527,840 | 2/1925 | Chomin | 280/7.13 |
| 1,823,942 | 9/1931 | Jung | 280/11.12 |
| 2,874,970 | 2/1959 | Mall | 280/7.13 |
| 2,917,315 | 12/1959 | Mihalik | 280/11.12 |
| 2,998,260 | 8/1961 | Meyer | 280/7.13 |
| 4,071,938 | 2/1978 | Chambers | 29/423 |
| 4,549,742 | 10/1985 | Husak et al. | 280/11.18 |
| 5,183,276 | 2/1993 | Pratt | 280/11.22 |
| 5,193,827 | 3/1993 | Olson | 280/7.13 |
| 5,320,366 | 6/1994 | Shing | 280/7.14 |
| 5,388,845 | 2/1995 | Soo | 280/11.17 |
| 5,484,148 | 1/1996 | Olivieri | 280/11.18 |
| 5,503,412 | 4/1996 | Hill | 280/7.13 |
| 5,505,467 | 4/1996 | Hill et al. | 280/11.16 |
| 5,531,462 | 7/1996 | Gu | 280/7.13 |
| 5,595,392 | 1/1997 | Casillas | 280/7.13 |
| 5,727,796 | 3/1998 | Zhang | 280/7.13 |
| 5,769,434 | 6/1998 | Wurthner | 280/11.18 |

FOREIGN PATENT DOCUMENTS

| | | |
|---|---|---|
| 2823564 | of 0000 | Germany . |
| 29600391 | of 0000 | Germany . |
| 29613965 | of 0000 | Germany . |
| 29700477 | of 0000 | Germany . |
| 29701044 | of 0000 | Germany . |
| 841871 | of 0000 | Germany . |
| 4222326 | 2/1993 | Germany . |
| 4223922 | 1/1994 | Germany . |
| 4230091 | 3/1994 | Germany . |
| 9417017 | 12/1994 | Germany . |
| 19504498 | 7/1995 | Germany . |
| 19509246 | 3/1996 | Germany . |
| 29600672 | 3/1996 | Germany . |
| 29602487 | 4/1996 | Germany . |
| 29600391 | 5/1996 | Germany . |
| 29602933 | 5/1996 | Germany . |
| 29605298 | 6/1996 | Germany . |
| 58386 | of 0000 | Romania . |

*Primary Examiner*—Paul N. Dickson
*Attorney, Agent, or Firm*—Baker Botts L.L.P.

[57] ABSTRACT

An interchangeable ice skate blade for use with a roller skate boot of the inline skate type includes a plurality of elongate bores or slots and a single circular bore or slot of a comparable size in the region of the edge of the blade remote from the ice-engaging edge. The combination of elongate and circular bores or slots allows the blade to be compatible with roller skate boots having different points of attachment of the blade to the boot while securely retaining the blade against unintended lengthwise or transverse movement relative to the boot.

8 Claims, 2 Drawing Sheets

ICE SKATE BLADE

BACKGROUND OF INVENTION

The invention concerns an ice skate blade for a roller skate of the inline skate type, which can be used as an ice skate boot, with an interchangeable carrier for receiving a plurality of wheels.

THE PRIOR ART

Ice skate blades of the foregoing kind are known in many different forms from the state of the art. Mention may just be made by way of example at this point of the following protection rights: G 94 17 017.7, G 296 00 391, G 296 00 672, P 42 23 922, G 296 05 298, G 296 02 933, G 296 02 487, P 42 30 091, P 195 04 498, P 42 22 326 and P 195 09 246 (G denotes "German utility model" and P stands for "German patent application").

However the various structures disclosed in the above-indicated state of the art suffer from disadvantages. Thus, for example, release of the ice skate blade or the mounting thereof on a roller skate of the inline skate type which can be used as an ice skate is a fairly problematical operation and always involves completely releasing the fixing means—for example holding pins or screws—which are arranged on the carrier and which usually accommodate the wheels for fixing them in position.

Release of an ice skate blade is appropriate for example if the ice skate blade is to be reground after a prolonged period of use or if it is to take up a minimum amount of space for transportation of the entire ice skate boot.

Furthermore, an ice skate blade which is to be mounted to a roller skate of the inline skate type involves the problem of fixing the blade to the boot. For that purpose it has been proposed in the state of the art that slots which extend parallel to the orientation of the blade may be provided on the side of the blade which is remote from the blade edge so that the blade can be accommodated by practically all current roller skates of the inline skate type. Adaptation of the ice skate blade to the various manufacturers or roller skate types of inline skate type is desirable because the spacing between the fixing mountings on the interchangeable carrier of the roller skate, such mountings being in the form of pins or screws fitted through the carrier, varies according to the manufacturer or inline skate type.

Ice skate blade inserts for converting an inline skate into an ice skating boot have also been proposed—see for example G 296 05 298—in which round bores are provided on the side of the ice skate blade carrier that is remote from the blade edge, so that the blade can then be used only for a given roller skate of the inline skate type, namely a roller skate in which the spacing of the holding pins or fitment screws is precisely the same spacing as in the case of the replacement ice skate blade. It is obvious that such a construction is not very user-friendly and the customer, when purchasing the interchangeable ice skate blade, must precisely know his roller skate of inline skate type in order to be able to obtain an ice skate blade which can be fitted to his roller skate of the inline skate type.

Moreover, the construction with slots which extend parallel to the ice skate blade suffers from the disadvantage that, if the holding means come loose, even if unintentionally, it can happen that the blade is displaced parallel to the boot below the boot, so that the user has the greatest difficulties in still safely using the ice skate.

The object of the present invention is to provide an ice skate blade in which the above-mentioned disadvantages are eliminated.

SUMMARY

In accordance with the invention, the foregoing and other objects are attained by an ice skate blade having the features of the kind set forth in the opening part of this specification, wherein, in the region remote from the blade edge, the ice skate blade has at least one approximately round bore or an opening of the width of an approximately round bore and one or more slots or openings of elongate extent which are open outwardly into the region remote from the blade edge, and the blade can be received by the interchangeable carrier instead of the wheels.

The construction according to the invention embraces two alternative embodiments of which partial features can be interchanged with each other. The one embodiment has an approximately circular bore and a plurality of, for example three, elongate bores. That embodiment is referred to hereinafter as the "closed structure".

In the other embodiment—hereinafter referred to as the "open structure"—both the approximately round bore and also the elongate bore are open outwardly, that is to say, the individual bores of the ice skate blade are arranged in the region remote from the blade edge and are opened in a direction remote from the blade edge, in such a way that they can be received for example by the interchangeable carrier of a roller skate of the inline skate type, without the holding pins or fitment screws arranged in the carrier—or other arresting mechanisms—having to be taken off in order to receive the ice skate blade according to the invention.

It is advantageous if, for fixing the ice skate blade, there are provided fixing elements which extend substantially over the entire length of the blade and which fix the blade centrally beneath the boot and which bear against the ice skate blade on both sides thereof in the region thereof that is remote from the blade edge.

In one embodiment the ice skate blade has three slots—for the closed structure—or three upwardly open openings of elongate width—for the open structure—and a bore—the closed structure—or an upwardly open opening of a diameter or a width which only slightly exceeds the usual diameter of a wheel holding pin—for the open structure.

The provision of an approximately round bore or an outwardly open opening of suitable diameter or width, respectively, always ensures that the blade is fixed in the longitudinal direction of the ice skate boot even if—for whatever reasons—the fixing of the blade should just come slightly loose. In addition, the configuration of the slots or the open opening of suitable length guarantees adaptation of the ice skate blade according to the invention to practically all roller skates of inline skate type, that are available on the market.

The above-mentioned features and properties of the ice skate blade according to the invention are extremely advantageous and have quite decisively contributed to the commercial success of the ice skate blade within a very short time after being introduced onto the market.

BRIEF DESCRIPTION OF THE DRAWINGS

The invention and the advantageous features and properties thereof are described in greater detail hereinafter with reference to examples illustrated in drawings in which.

DETAILED DESCRIPTION

Figure 1:
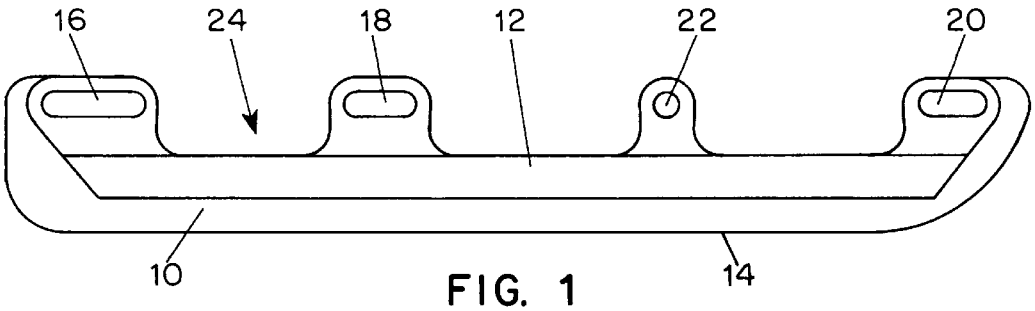
FIG. 1 is a side view of one embodiment of an ice skate blade according to the invention with a fitting portion applied thereto as a fixing element.

FIG. 1 shows a side view of an ice skate blade 10 and a fixing element in the form of a fitting portion 12. In the region which is remote from the blade surface or edge 14, both the ice skate blade 10 and the fixing element 12 have openings (long bores) of which three 16, 18, 20 are of an elongate configuration in parallel relationship to the ice skate blade edge and one 22 is in the form of an approximately circular round bore.

Figure 2:
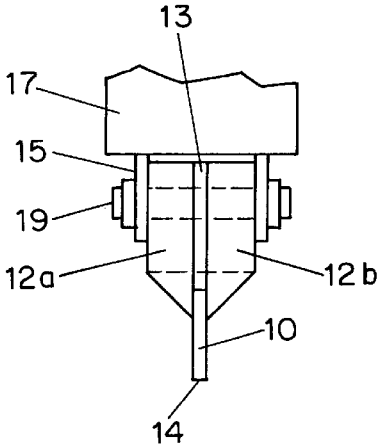
FIG. 2 is a front view of an ice skate blade according to the embodiment of FIG. 1.
Figure 3:
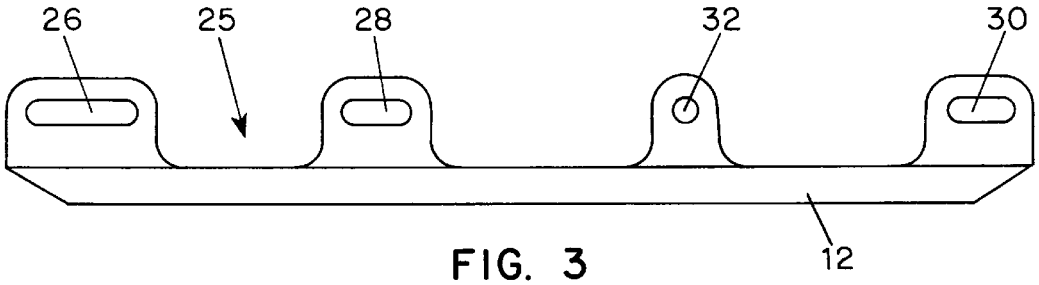
FIG. 3 is a side view of a fitting portion.
Figure 4:
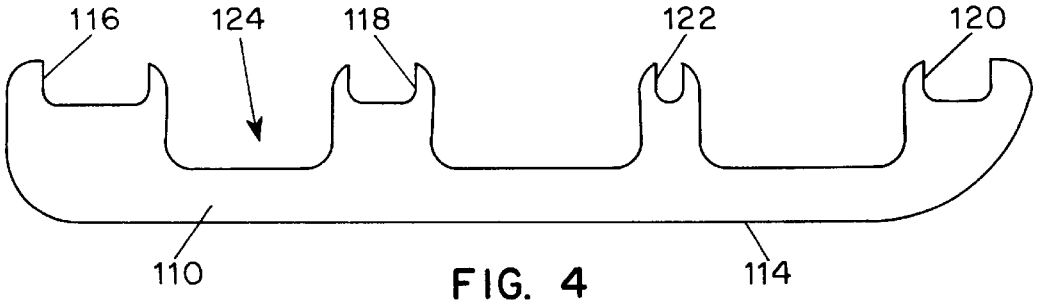
FIG. 4 is a side view of another embodiment of an ice skate blade according to the invention.

FIGS. 3 and 4 show the detailed structure of the fixing element 12 and the ice skate blade 10. FIG. 2 shows a front view of the arrangement of the ice skate blade 10 and two fitting portions 12*a*, 12*b* upon being received by a roller skate and upon simultaneous functional conversion thereof to operate as an ice skate boot. It will be seen in this respect that there are provided two fitting portions 12*a* and 12*b* which are each arranged on respective sides of the ice skate blades 10 and which thus fix it centrally beneath the ice skate boot (not shown). It is advantageous if the fitting portions 12*a*, 12*b* extend to relatively close to the blade contact edge 13, in the region remote from the boot, in order to prevent undesirable oscillations and vibrations when used for ice skating and thus to give the ice skater a safe steady sliding feel.

Figure 6:
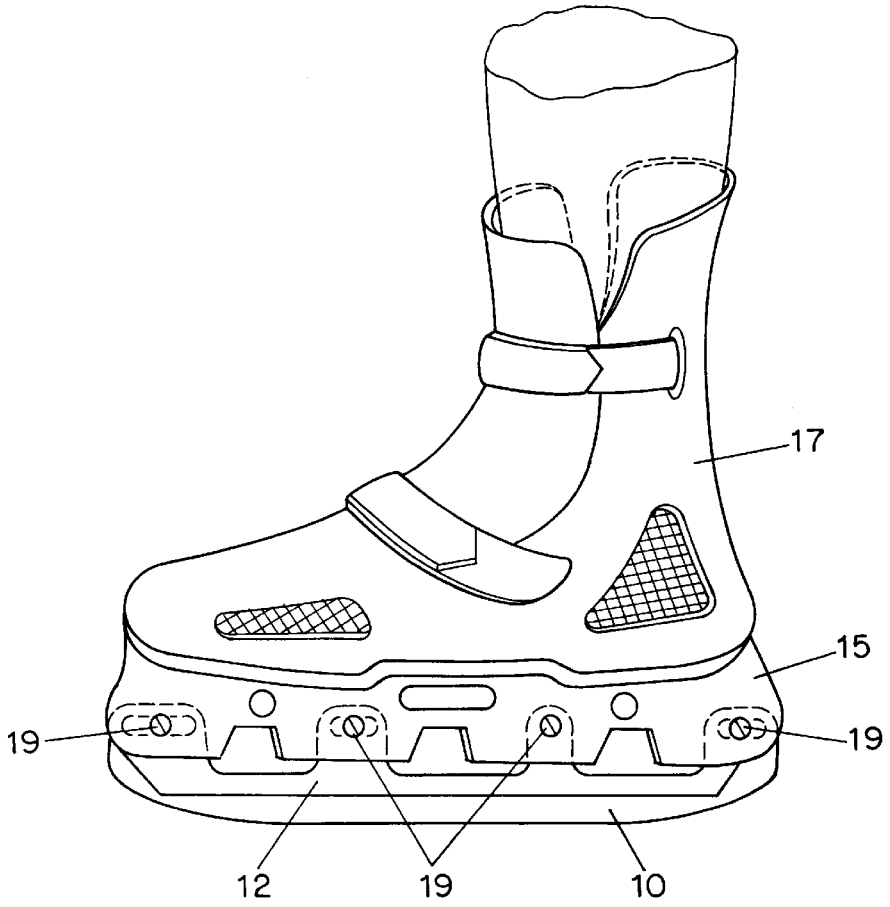
FIG. 6 is a perspective view of a roller skate boot of the inline skate type to which an ice skate blade according to the invention has been attached.

As shown in FIGS. 2 and 6, the ice skate blade 10 and the fitting portions 12 are fixed to the mounting carrier 15 of the roller skate boot 17 in a conventional manner by screws, quick-action clamping devices (for example as are known from bicycles), or other forms of holding pins 19 which pass through both the bores and the openings in the fitting portions 12 and also the ice skate blade 10 and fix same to the holding pin mounting carrier 15 of the roller skate.

FIG. 3 is a side view of a fitting portion 12 which has three slots 26, 28, 30 and a round bore 32. The round bore 32 is a fixing point in two respects. On the one hand, the round bore 32 fixes the position relative to the boot and even if the holding pin comes loose in the bore 32, even if unintentionally, the fitting portion 12 nonetheless remains in its intended or desired position, in both an axial direction relative to the boot and also in a perpendicular direction thereto.

The provision of the slots 26, 28, 30 has the advantage that the fitting portion or fitting portions 12 can be adapted to the most widely varying spacings of the most widely varying manufacturers and types of roller skate.

FIG. 4 is a side view of an ice skate blade 110 according to the invention in which the openings 116, 118, 120 for receiving the fixing means are not closed as in the case of the fitting portion 12, but are of an "open" configuration, that is to say, in the region of the ice skate blade 112 which is remote from the blade edge 114, the openings are not defined or closed in an outward direction, but the length of the openings in parallel relationship to the ice skate blade surface is unaltered. Thus, as in the case of the fitting portion 12, that permits flexible use of the ice skate blade in relation to the roller skate of inline skate type from the most widely varying manufacturers and of the most widely varying types. By virtue of its length which is restricted in the axial direction of the boot, the opening 122 serves as a fixing point, like the bore 22 in the case of the fitting portion 12, while by virtue of the elongate configuration of the openings 116, 118, 120 at the position of the holding pins or screws of the roller skate, such pins or screws can come to bear in the openings 116, 118, 120.

If, after the ice skate blade had been fixed to the boot, it is necessary to grind or realign the ice skate blade edge 114, the holding means are only slightly loosened and the ice skate blade 110 can be detached from the boot and clamped in a grinding device. That permits very accurate grinding or very accurate re-alignment of the ice skate blade surface to give the desired kind of grinds, for example hollow grind, G-grind, etc.

Figure 5:
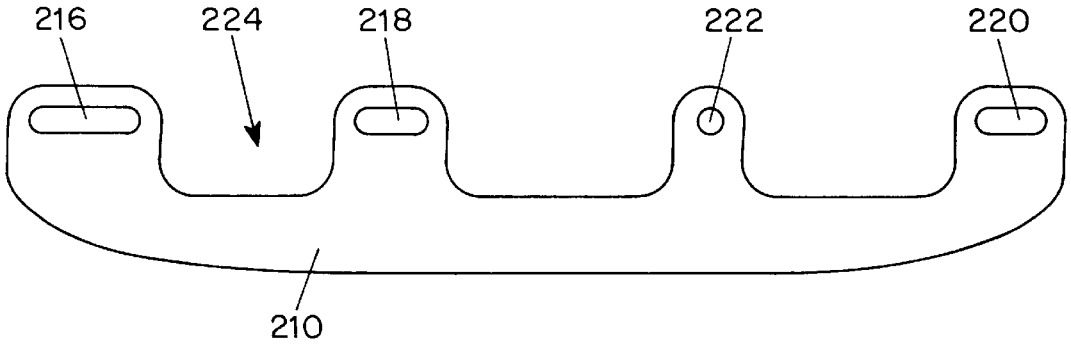
FIG. 5 is a side view of still another embodiment of an ice skate blade according to the invention.

FIG. 5 shows a configuration of the ice skate blade 210 which is an alternative to FIG. 4, in which, as in the case of the fitting portion 12, the openings 216, 218, 220, 222 for receiving the holding pins or bolts are of a "closed" configuration so that, when the ice skate blade 210 is removed from the boot, the holding pins or bolts must be removed therefrom in the region of the openings 216, 218, 220, 222.

As a weight saving feature, the regions 24, 124, 224 between the openings in the blades 10, 110, 210 are apertured or cutaway. The same is preferably also done in the regions 25 between the openings 26, 28, 30, 32 in the fitting portions 12.

We claim:

1. An ice skate blade for a roller skate of the incline skate type having an elongate carrier with at least four transversely extending openings spaced apart lengthwise thereof for receiving corresponding ones of at least four transversely extending axles for rotatable mounting on the carrier at least four roller skate wheels, the improvement in said ice skate blade comprising:

said ice skate blade having a front end and a rear end and a lengthwise extent there between, said blade further having a first front-to-rear extending edge forming an ice-contacting blade edge, a second front-to-rear extending edge spaced from said first edge, and substantially parallel first and second sides extending between said first and second edges;

said ice skate blade having extending transversely there through from said first side to said second side (a) a substantially-circular opening (b) first and second substantially-elongate openings located between said substantially-circular opening and one of said front and rear ends, and (c) a third substantially-circular opening located between said substantially-circular opening and the other of said front and said rear ends;

all of said openings being located adjacent said second edge and aligned lengthwise of said blade along a line substantially parallel to said first edge;

said elongate openings being elongated in the lengthwise direction of said blade; and the elongate extent of said elongate openings increasing with increasing distance of said elongate openings from said substantially circular opening;

whereby, upon alignment of said substantially circular opening with the transverse axle opening in the carrier that is located second in line from an end of the carrier, said elongate openings in said blade align with respective ones of the other transverse axle openings in the carrier.

2. An ice skate blade as set forth in claim 1, said blade further comprising a fixing element for fixing the blade to the carrier, said fixing element extending over substantially the entire length of the blade along said first side thereof.

3. An ice skate blade as set forth in claim 2, further comprising a second fixing element, said second fixing element bearing against the ice skate blade on said second side.

4. An ice skate blade as set forth in claim 1, wherein said second edge has notches cut out between said openings, whereby the weight of the blade is reduced.

5. An ice skate blade for a roller skate of the incline skate type having an elongate carrier with at least four transversely extending openings spaced apart lengthwise thereof for receiving corresponding ones of at least four transversely extending axles for rotatably mounting on the carrier at least four roller skate wheels, said ice skate blade comprising:

said ice skate blade having a front end and a rear end and a lengthwise extent there between, said blade further having a first front-to-rear extending edge forming an ice-contacting blade edge, a second front-to-rear extending edge spaced from said first edge, and substantially parallel first and second sides extending between said first and second edges;

said ice skate blade having extending transversely there through from said first side to said second side (a) a substantially-arcuate attachment notch, (b) first and second substantially-elongate attachment notches located between said substantially-arcuate attachment notch and one of said front and rear ends and (c) a third substantially-elongate attachment notch located between said substantially-arcuate notch and the other of said front and said rear ends;

all of said notches being cut into said second edge and aligned lengthwise of said blade along a line substantially parallel to said first edge;

said substantially-elongate notches being elongated in the lengthwise direction of said blade; and the elongate extent of said substantially-elongate notches increasing with increasing distance of said substantially-elongate notches from said substantially-arcuate notch;

whereby, upon alignment of said substantially-arcuate notch with the transverse axle opening in the carrier that is located second in line from an end of the carrier, said substantially-elongate notches in said blade align with respective ones of the other transverse axle openings in the carrier.

6. An ice skate blade as set forth in claim 5, further comprising a first fixing element for fixing the blade to the carrier, said first fixing element extending over substantially the entire length of the blade along said first side thereof.

7. An ice skate blade as set forth in claim 6, further comprising a second fixing element, said second fixing element bearing against the ice skate blade on a side opposite the first side of the blade.

8. An ice skate blade as set forth in claim 5, wherein said second edge has notches cut out between said attachment notches, whereby the weight of the blade is reduced.

* * * * *